US006697776B1

(12) United States Patent
Fayad et al.

(10) Patent No.: US 6,697,776 B1
(45) Date of Patent: Feb. 24, 2004

(54) DYNAMIC SIGNAL DETECTOR SYSTEM AND METHOD

(75) Inventors: Gilles G. Fayad, Newport Beach, CA (US); Huan-Yu Su, San Clemente, CA (US)

(73) Assignee: Mindspeed Technologies, Inc., Newport Beach, CA (US)

( * ) Notice: Subject to any disclaimer, the term of this patent is extended or adjusted under 35 U.S.C. 154(b) by 615 days.

(21) Appl. No.: 09/628,891

(22) Filed: Jul. 31, 2000

(51) Int. Cl.[7] ..... G10L 11/06
(52) U.S. Cl. ..... 704/233; 704/208; 704/214
(58) Field of Search ..... 704/270, 275, 704/233, 256, 230, 227, 208, 214

(56) References Cited

U.S. PATENT DOCUMENTS 5,991,442 A * 11/1999 Yamada et al. ..... 382/218
6,070,137 A * 5/2000 Bloebaum et al. ..... 704/227
6,161,089 A * 12/2000 Hardwick ..... 704/230
6,418,412 B1 * 7/2002 Asghar et al. ..... 704/256

* cited by examiner

*Primary Examiner*—Susan McFadden
(74) *Attorney, Agent, or Firm*—Farjami & Farjami LLP

(57) ABSTRACT

A digitized signal detection system where the bit rate encoding is changed dynamically to provide encoding for different type signals and formats at bit rates optimized to properly reconstruct the input signal whether speech or non-speech and therefore can transfer signals of different character on a frame by frame basis. A change of encoding format can make the system a speech or music recognizer dependent what is to be listened for. Three basic components a recognizer which categorizes the type of input signal, an evaluator which evaluates the category of quality of the reconstructed signal and a recommender which make as recommendation based on the quality to change standards to encode the signals received pursuant to a standard which provides for improved quality. The dynamic signal detector receives the input signal directly and extracts the parameters for evaluation. These parameters are tested and a determination made if a switch of standards are required. To improve the reconstructed signal. The dynamic signal detector is provided at both ends of the communication channel. One located at the encoder side which detects the signal in the first instance and form the parameters determines the character of the signal and a determination is made as to the likelihood of a quality signal being generated by the then current encoder and whether a decreased or increased bandwidth would be more appropriate.

16 Claims, 7 Drawing Sheets

DYNAMIC SIGNAL DETECTOR SYSTEM AND METHOD

BACKGROUND OF THE INVENTION

1. Field of the Invention

The field of this invention relates to signal processing which identifys the type of signal received in order to optimize the transmission and reception of said signal. More particularly, the field of this invention relates to audio signal processing through an encoder selected to optimize the quality of the signal on decoding and optimize the use of bandwidth.

2. Related Art

The related art is replete with detectors and encoders which encodes audio signals which are related to speech. Speech signals are processed and parameters developed in the form of feature vectors which may transmitted in digital form and later combined in a decoder to reconstruct the speech.

Digital speech signals operate on data transmission media having limited available bandwidth. Accordingly, data transmission rates are minimized using various techniques which are geared to optimize speech signals to maintain a high perceptual quality. These systems include all transmission modes such as wireless, Voice Over IP, direct wire, cable, ISDN, modems and the like.

However, such systems do not typically address the problem associated with non-speech signals such as music because the systems are optimized for the human vocal tract. Since these systems are optimized for voice, such systems do not process other non-speech signals such as music very well.

The International Telecommunication Union has established a number of standards for speech processing. Among these are G.729 standard which processes speech at 8 Kbits/second The G.729 standard provides good quality transmission of speech while minimizing band width. This standard presents a standard way of performing the integration and expansion of speech signals to optimize speech quality and ensures communication quality.

Recently, the G.729 standard has been expanded so as to include music processing capability (Annex E at 11.8 Kbits/second, G.729E). Furthermore, the standards now include DTX (Annex G) functionality for 11.8 Kbits/second CS-ACELP algorithm in Annex E. The G.729G standard provides for music detection immediately following Voice Activity Detection (VAD). The music detection algorithm corrects the decision from the VAD in the presence of music signals.

Many systems or methods can currently distinguish between voice and music but do not dynamically adjust encoding systems or bit rate to achieve a better trade-off between maintaining high perceptual quality (where high bit-rate is typically required) and reducing bandwidth requirement for communication increase the quality of the signal.

What is required is a system such as the present invention which can switch the encoding standard or any other standard or technique as required to address the high bit rate requirement of high content signals dynamically so that a more acceptable reconstruction of the signal can take place while allowing low bit rate for speech signals. This requires a system which can provide flexibility for selection of encoding techniques and the degree of granularity applied.

SUMMARY OF THE INVENTION

The present invention provides a system where the bit rate encoding or the associated transport mechanism can be changed dynamically to provide encoding for different types of signals at bit rates or encoding methods optimized to properly reconstruct the input signal whether speech or non-speech. It should be noted that non-speech signals can include modem signals and facsimile signals.

In the present invention the application is driven through a change of parameters that can make the system a speech or music recognizer over an IP gateway, for example, dependent what signal is to be listened for. While the dynamic signal selection of the present invention is illustrated using voice over IP, it is equally applicable to other transmission systems, such as wireless, DSI, voice over cable systems and other transmission systems and may be operated on a continuous, incremental or packetized/frame basis.

The dynamic signal detector of the present invention, a includes three basic components a recognizing module which categorizes the type of input signal, an evaluation or classification module which evaluates the quality of the signal based on the category and a recommendation module which makes a recommendation based on the quality of the signal to change the standard used to encode the signals received to improve quality.

The dynamic signal detector receives the digitized input signal and uses an algorithm to extract the feature vectors parameters for evaluation. These parameters are tested and a determination made if a switch of encoding standard or a modification of the transport parameters are required to improve the reconstructed signal. External signals may also be available for evaluation dependent on the particular system.

The dynamic signal detector may be present at both ends of the communication channel. Each is located on the encoder side which detects the digitized signal in the first instance and evaluates the feature vectors to determine the character of the signal. The dynamic signal detector determines whether a quality signal can be generated by the then current encoder and selects a decreased or increased bitrate or other encoding format as required.

For example, if the signal is music a higher bitrate standard than voice is applied. If the signal is voice a lower bandwidth standard will do. If the signal is a modem or a facsimile and modem or facsimile format is applied.

This evaluation, recommendation and change can occur on a continuous basis or on a frame by frame or packet by packet basis dependent on the nature of the signal. Statistical techniques for evaluation of frames or packets and their associated recommendations can also be applied over an arbitrary number of samples, or by whatever other means is suitable for the application.

The additional features of the invention will be described in more detail in the specific embodiment described below.

DESCRIPTION OF A SPECIFIC EMBODIMENT

Quality is a subjective measurement and such techniques as Mean Opinion Score (MOS) or an E-model (Evaluation Model) for speech, or other mechanisms are used to indicate quality. Perceptible quality speech based on the Mean Opinion Score (MOS), is as set forth in Table I below, of at least 3 or higher to be tolerable.

TABLE I

| Mean Opinion Score | |
|---|---|
| MOS | QUALITY |
| 5 | Excellent |
| 4 | Toll-PSTN |
| 3 | Some Listening Effort |
| 2 | Significant Listening Effort |
| 1 | Unintelligible |

Figure 1:
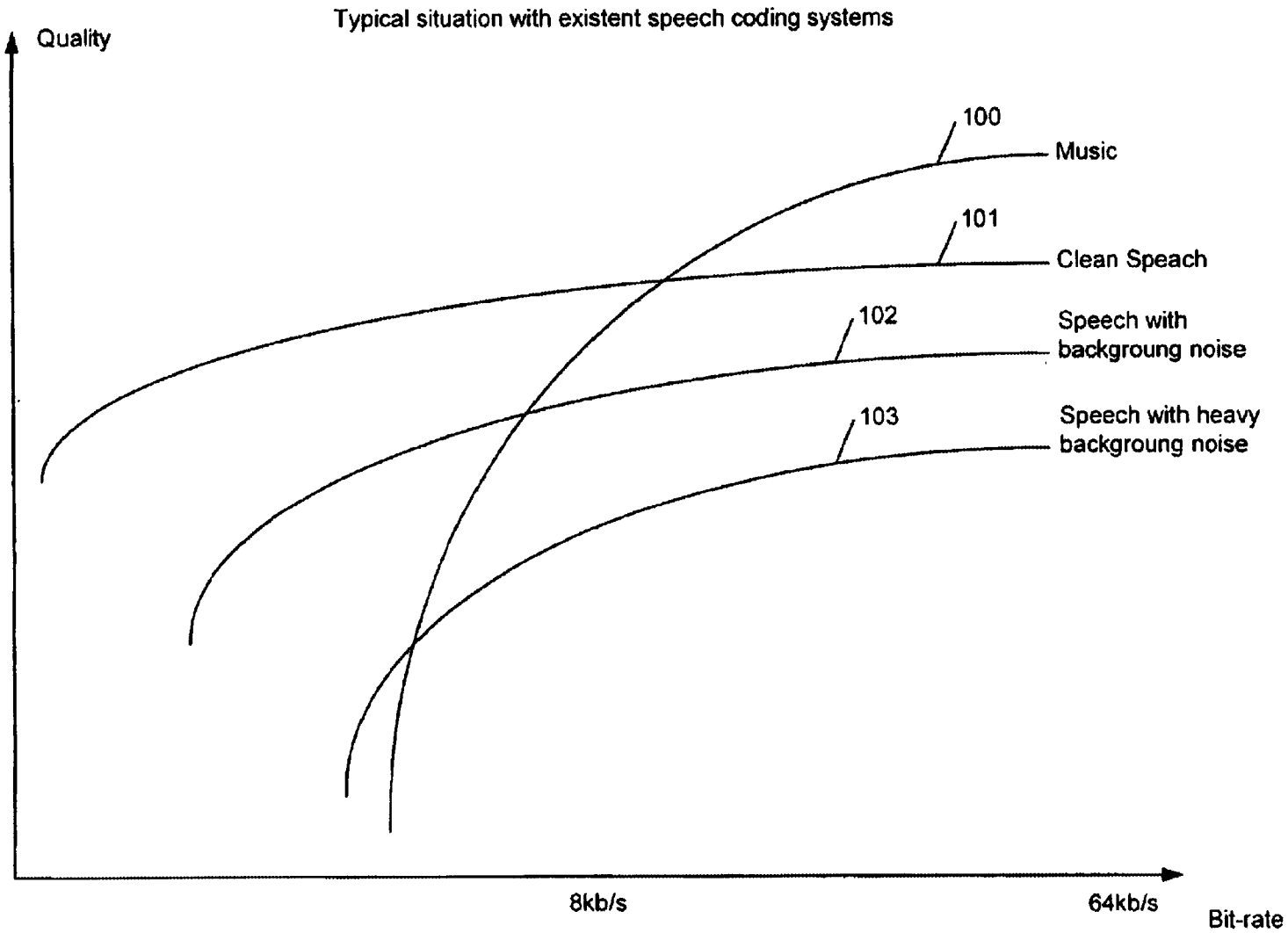
FIG. 1 is a graph of the relationship of bit rate of various types of signals to quality.

The current invention as implemented evaluates the digitized signal and provides classifications which associate the complexity of the signal to the encoding standard which provides the best quality at the optimum bit rate. FIG. 1 illustrates the different quality considerations for various speech signal such as clean speech, 101, Speech with background noise, 102, speech with heavy background noise, 103 as compared to music, 100 with existing speech coding systems.

The present invention comprises a recognition module, an evaluation module and a recommendation module. Because the significant cascade quality drop for low bit-rate speech codecs when used with music signals, it is essential to be able to detect the nature of the incoming signals as being music, active speech or background noise (silence being a special case of background noise). The role of the recognition module which is model the perceived quality of an audio signal by extracting the feature vectors, For the evaluation module, its role is to identify where would be best tradeoff point given the nature of the incoming signal. For example, if the incoming signal is active speech without background noise, then it is known that coding it as G.723.1 at 6.3 kb/s or above will result in sufficient quality because the quality curve of FIG. 1 is fairly flat after that point (the saturation region), but if the incoming signal is active speech with background noise, then the evaluation module may need to identify the type of noise (room noise, car noise, street noise, interference talker, stationary or non-stationary noises, etc.) and the noise level. An evaluation of the feature vectors resulting in a given circumstance may need to be determined on a limited trial and error basis. If the incoming signal is vocal music, composed music, or something else.

In order to generalize the system, the evaluation module might consider other input such as desired tradeoff from a network planning point of view. For example, one user might decide that quality is the most important factor to be considered in the evaluation process, while another user might decide that some degradation is acceptable provided that there is a bit-rate reduction.

Finally, the recommendation module can be updated with the characteristics of various speech coding systems available from time to time and recommend the best usage of a particular speech coding system, considering the outcome of the evaluation module and the availability of various speech coding systems.

Figure 2:
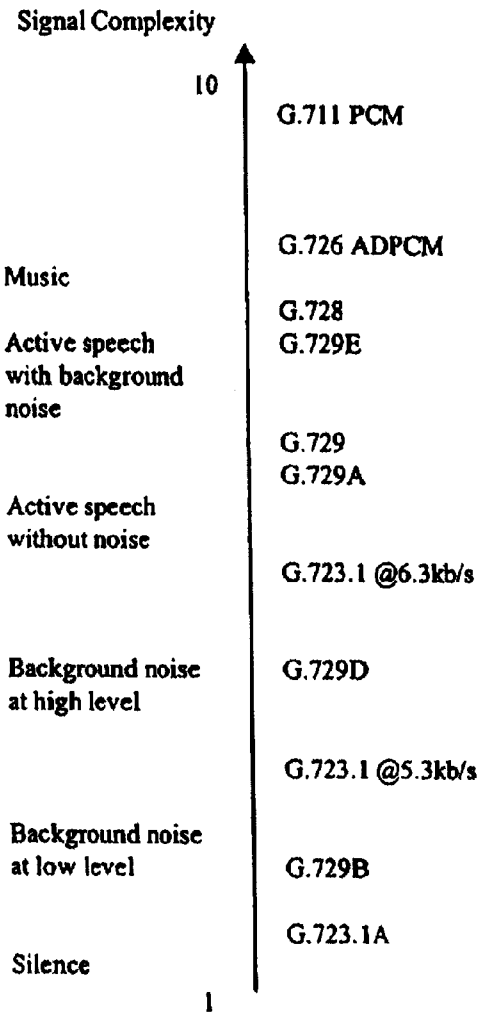
FIG. 2 is a chart relating signal complexity to various encoding standards.

FIG. 2 gives an example of the relative ordering of various signals of a complexity rating of 1 to 10 where 10 is the highest complexity signal compared to the relative complexity of the encoding standards. Silence being the lowest complexity signal would be encoded using G.723.1A while true music would be encoded using G.728 or G.726 ADPCM. G.711 could be used to encode any signal but since it is at 64 Kbits/s it does not provide any bit rate savings. The purpose of the present invention is to provide a dynamic way to evaluate and encode signals to take advantage of the application of a standard which is adequate to encode the signal dependent on its complexity.

For example, the VAD module and the music detector found in the G.729, Annex G standard returns basically a three level indication: (1) music, (2) active speech and music, and (3) background noise.

A very simple evaluation module could be found in the TIA IS 127 (cdma EVRC) standard, which is incorporated herein by reference or other standards or techniques which are or may be available from time to time. Using such a system the evaluation or classification module will analyze the complexity of the incoming signal based on a set of predetermined criteria. This module can be viewed as being a finer signal classifier that will return a much finer multi-level indication. Regardless of the system used, the recommendation module of the present invention will take the particular classification and will recommend the use of the best standard available at the time for optimum encoding of the signal evaluated.

The specific embodiment of the present invention is described in the form of a Voice over IP system which bypasses a typical PSTN network. However, it should be noted at the outset that the invention described may be applied to a wireless network, LAN, WAN, direct line network, or virtually any other point to point transmission system, and can apply also to other media like fax over packet, modem over packet, and other communication systems and is not intended to be limited to the specific embodiment described nor indeed is the invention limited to a packetized system.

Figure 3:
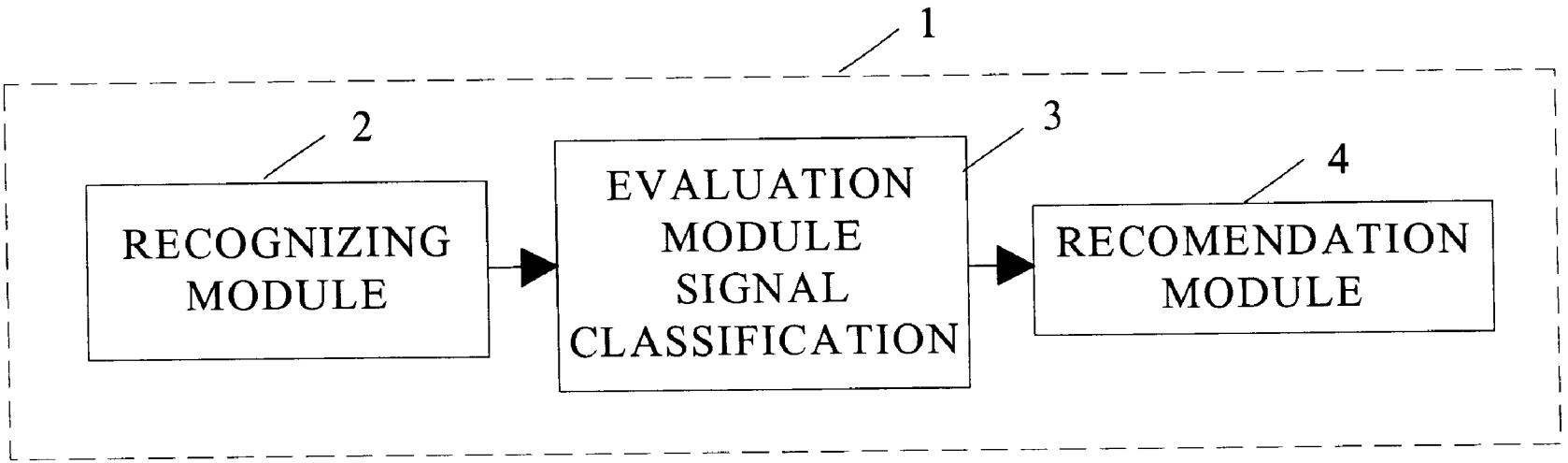
FIG. 3 is a block diagram of the dynamic signal detector.

The basic components of the dynamic signal detector 1 of the present invention are shown in FIG. 3 in block diagram form. FIG. 3 illustrates a recognizing module 2 which generates parameters representative of the signal or signal frame being processed. The parameters are passed to the Evaluation Module 3 which evaluates the audio signal based on the parameters to determine the class of the signals as set forth in FIG. 2. This is accomplished by the evaluation of the parameters (feature vectors) and classifying the signal as silence, background noise, active speech without noise, active speech with background noise, or music. Some trial and error is required to adjust the parameter levels to provide the perceived optimum performance dependent on the particular application. Finally, a recommendation module 4 makes a recommendation based on the classification of the complexity of the signal as to which codex is to be used to code the signal.

Thus, for example, when an audio signal transmitted at 8 Kbits/sec pursuant to a G.729A standard ends and music on hold commences, the present invention detects that a music signal is present in accordance with the G.729G standard. That signal is evaluated and a determination made that a higher bandwidth than that being currently used is required. The recommendation module 4 then recommends switching the encoding standard to a higher bit rate such as G.726 ADPCM at 24, 32, or 40 Kbits/second, all of which are very adequate for music. Other voice standards exist such as G.723.1 at 5.3 and 6.3 Kbits/second and most recently G.729E at 11.2 Kbits/second as noted above.

The present invention detects the higher bit rate signal requirements by determining the character of the feature vectors of the signal either on a frame by frame basis or as a continuous signal dependent on the system and classifies the nature of the signal on the continuum of FIG. 2. Based on the users desired quality v/s bit rate evaluation as noted above specific classes of signals can be used to make a recommendation to change the bit rate capability for input digital audio signals that require higher bit rate data to be properly reconstructed in accordance with user goals such as optimizing bit rate and quality or the best quality regardless of bit rate. Music signals are but one example of such signals.

Figure 4:
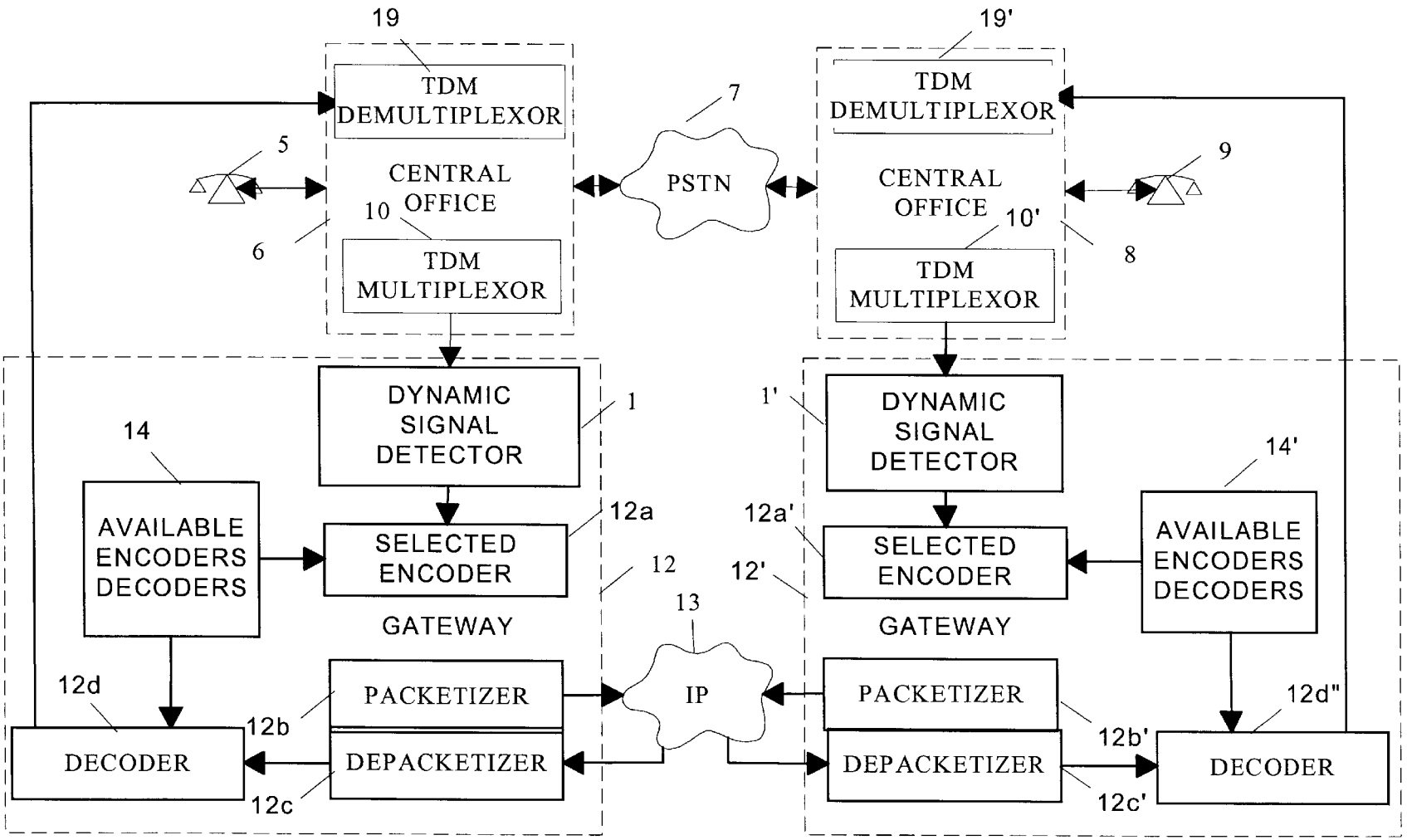
FIG. 4 is a block diagram of a typical PSTN system having an integrated voice over IP system.

FIG. 4 shows a typical telephone set 5 connected over a twisted wire pair to a central office 6, which communicates through a standard analog PSTN network 7 to another central office 8 which communicates with another telephone set 9 over a twisted wire pair. The PSTN is a dedicated bandwidth which is a synchronous stream due to allocated channels from one end to the other. FIG. 4 further shows the central office including a Time Division Multiplex module (TDM) which multiplexes the data into time segments which are individually evaluated by the dynamic signal detector 1 of the present invention which is usually co-located with the other components of the gateway 12 its functionality may be located elsewhere where necessary or appropriate. It should be noted that multiplexing while shown in this example is not a necessary element of this invention as non-multiplexed signals may also be processed. The gateway 12 then selects the encoder 12*a* from a group of encoding standards 14 based on the recommendation of the dynamic signal detector 1 and encodes the signal. The gateway then uses a packetizer 12*b* to convert the encoded signal data into packetized data which is then applied to the voice over IP gateway 12. The IP gateway 12 is connected to the IP space 13 and then communicates with another gateway 12' which extracts or de-packetizes using a de-packetizer 12*c*' and the de-packetized data is decoded by a decoder 12*d*' and is coupled to a TDM demultiplexor module 19' which demultiplexes the decoded signal and communicates with the central office 8 and then to the telephone set 9. When the receiving location encodes data for transmission to the original location, the process is reversed, gateway 12 which extracts or de-packetizes the packet using a de-packetizer 12*c* and the de-packetized data is decoded by a decoder 12*d* and coupled to a TDM demultiplexor 19 which communicates with the central office 6 and then to the telephone set 5. It is noted that TDM multiplexing and demultiplexing is one of many choices known in the art to time divide multiplex the data and the present invention is not intended to be restricted to TDM. In addition, there may be a number of different channels (frequency multiplexing signals) processed at the same time and multiple channel packetized for transmission over the IP. The dynamic signal detector 1 incorporated into the gateway 12, and the gateway 12' respectively for each side of the network although in certain embodiments, e.g. those which do not involve a gateway, the dynamic signal detector 1 may be elsewhere.

Figure 5:
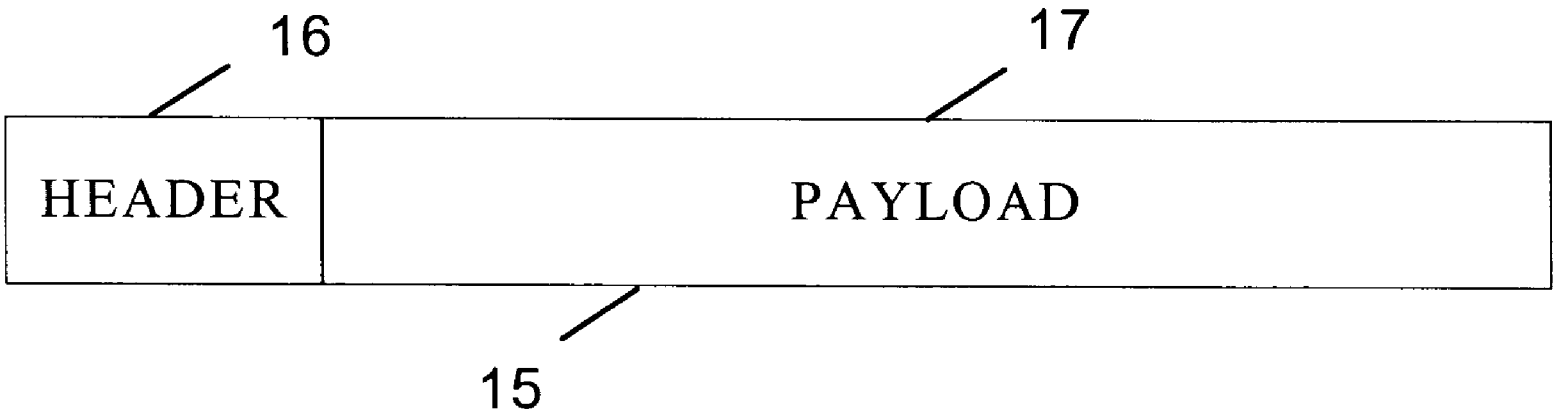
FIG. 5 is a schematic of a packet of data with a header and a payload.

As shown in FIG. 5, the IP packets 15 which are generated by the gateway 12 and the gateway 12' include a header 16 and a payload 17. The header includes information regarding the environment for the packet, that is, the address and other routing information as well as parametric information. The payload 17 contains the encoded data for a given half-duplex (i.e., one-way communication) channel. Two such channels are usually required for a full-duplex communication, as is required for normal interactive communication.

Unlike the dedicated PSTN network where audio is encoded in a standard G.711, the IP network is a shared bandwidth network which means that the bandwidth may be significantly narrower than in the case of a dedicated network. Accordingly, other standards such as G.723.1 which runs at a bandwidth 6.3 Kbits/sec or as G.729. at 8 Kbits per second are used for speech.

Packets are not as safe as information over a dedicated network because a voice packet may be lost. If a packet gets dropped the audio must be rebuilt or played without the missing data. This results in audio performance degradation. Multiple identical packets may be sent in the event that the loss is unacceptable to enable the receipt of sufficient packets required for acceptable speech.

When transmission occurs over the IP or other network between telephone sets, some level of quality is expected. Often when on hold in a speech environment, music is introduced to make the person on hold tolerate the hold better. Unfortunately, the CELP codex does not reproduce the music or other non-speech signals well.

Table III below shows the various PCM format standards which can be utilized to encode audio signals. Each of the standards includes parametric information (feature vectors) and the process for detecting and coding required by the standard.

TABLE III

Audio Coding Standards

| Standard | Input Sample Rate | Frequency Bandwidth | Frame size (ms) | Bit-rate (kbps) | Technology |
|---|---|---|---|---|---|
| G.711 | 8 KHz | 4 KHz | 0.125 | 64 | Non-linear PCM |
| G.721 | 8 KHz | 4 KHz | 0.125 | 32 | ADPCM |
| G.722 | 16 KHz | 7 KHz | | 64 | ADPCM |
| G.723 | 8 KHz | 4 KHz | 0.125 | 24, 40 | ADPCM |
| G.723.1 | 8 KHz | 4 KHz | 30 | 5.3, 6.3-Main body 0(DTX), 0.8-Annex A | CELP |
| G.726 | 8 KHz | 4 KHz | 0.125 | 16, 24, 32, 40 | ADPCM |
| G.727 | 8 KHz | 4 KHz | 0.125 | 16, 24, 32, 40 | Embedded ADPCM |
| G.728 | 8 KHz | 4 KHz | 2.5 | 16 | LD-CELP |
| G.729 | 8 KHz | 4 KHz | 10 | 8-Mainbody 8-Annex A 0(DTX), 1.5-Annex B Floating-pt, Annex C 6.4-Annex D 11.2-Annex E D + B = Annex F E + B = Annex G D + E = Annex H Main + A + B +D + E = Annex 1 | CELP |
| IS-54 | 8 KHz | 4 KHz | 20 | 7.95 | VSELP |

TABLE III-continued

| Audio Coding Standards | | | | | |
|---|---|---|---|---|---|
| Standard | Input Sample Rate | Frequency Bandwidth | Frame size (ms) | Bit-rate (kbps) | Technology |
| IS-96 | 8 KHz | 4 KHz | 20 | 0.8, 2.0, 4.0, 8.5 | CELP, VBR |
| IS-733 | 8 KHz | 4 KHz | 20 | 1.0, 2.8, 6.2, 13.3 | CELP, VBR |
| IS-127 | 8 KHz | 4 KHz | 20 | 0.8, 4.0, 8.5 | RCELP, VBR |
| IS-641 | 8 KHz | 4 KHz | 20 | 7.4 | ACELP |
| GSMFR | 8 KHz | 4 KHz | 20 | 13 | RP-LTP |
| GSM EFR | 8 KHz | 4 KHz | 20 | 12.2 | ACELP |
| GSM AMR | 8 KHz | 4 KHz | 20 | 4.75, 5.15, 5.9, 6.7, 7.4, 7.95, 10.2, 12.2 | ACELP |

Note:
CELP = Code Excited Linear Prediction
VSELP = Vector-sum excited linear prediction
ACELP = Algebraic CELP
LD-CELP = Low-delay CELP
RCELP = Relaxed CELP
VBR = Variable bit rate
FR = Full Rate
EFR = Enhanced Full-Rate
AMR = Adaptive Multi-Rate
IS- = Interim Standard
DTX = Discontinuous Transmission The encoded signal is inserted into the packet 15 payload 17 and parametric information including formatting information is inserted into header 16 and the encoded packetized audio is output 26. It should be noted that as the packet traverses the IP network, additional headers may be added during routing.

Figure 6A:
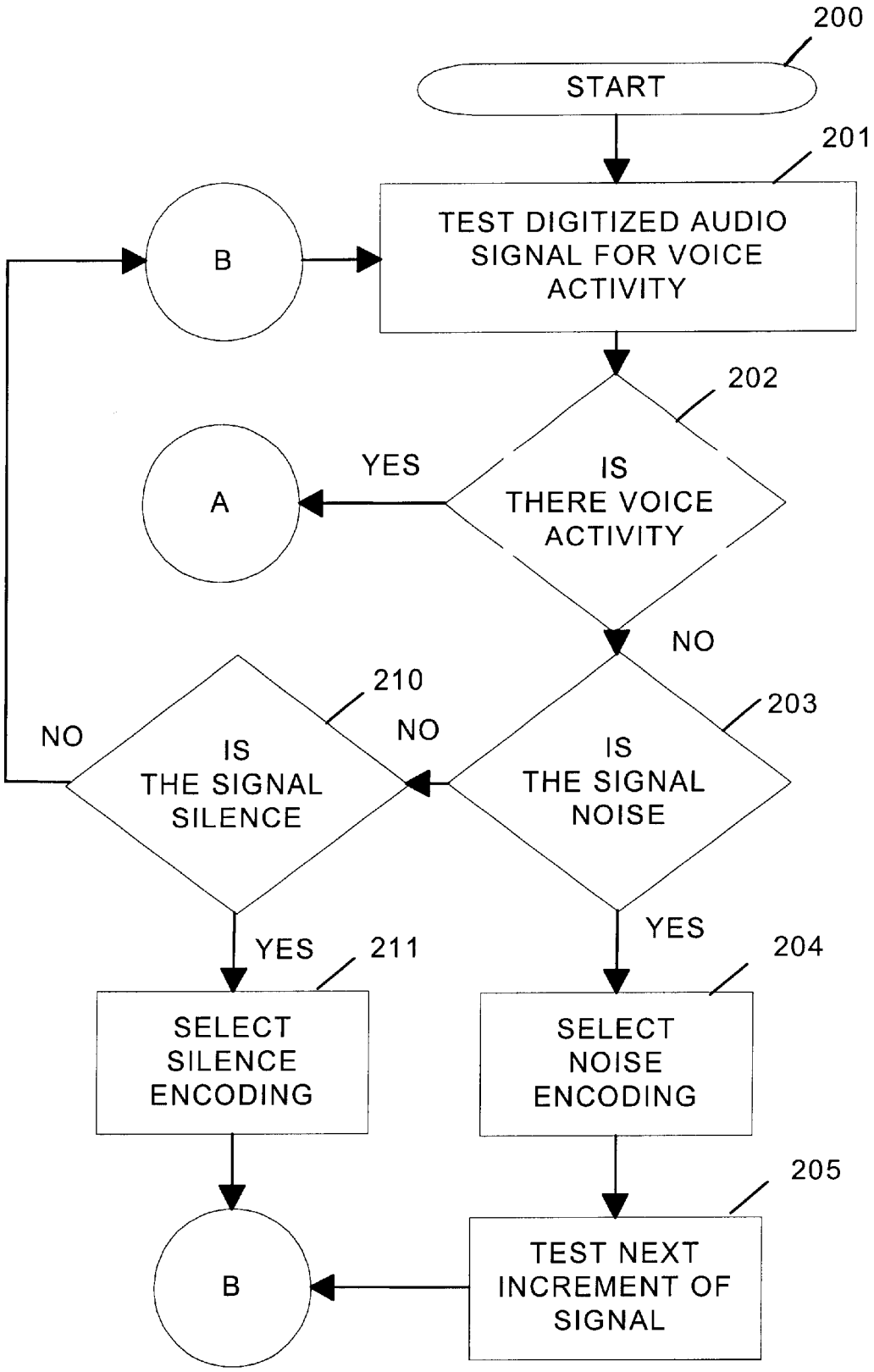
FIGS. 6A and B are a flow chart of the recognition, classification and recommendation system.
Figure 6B:
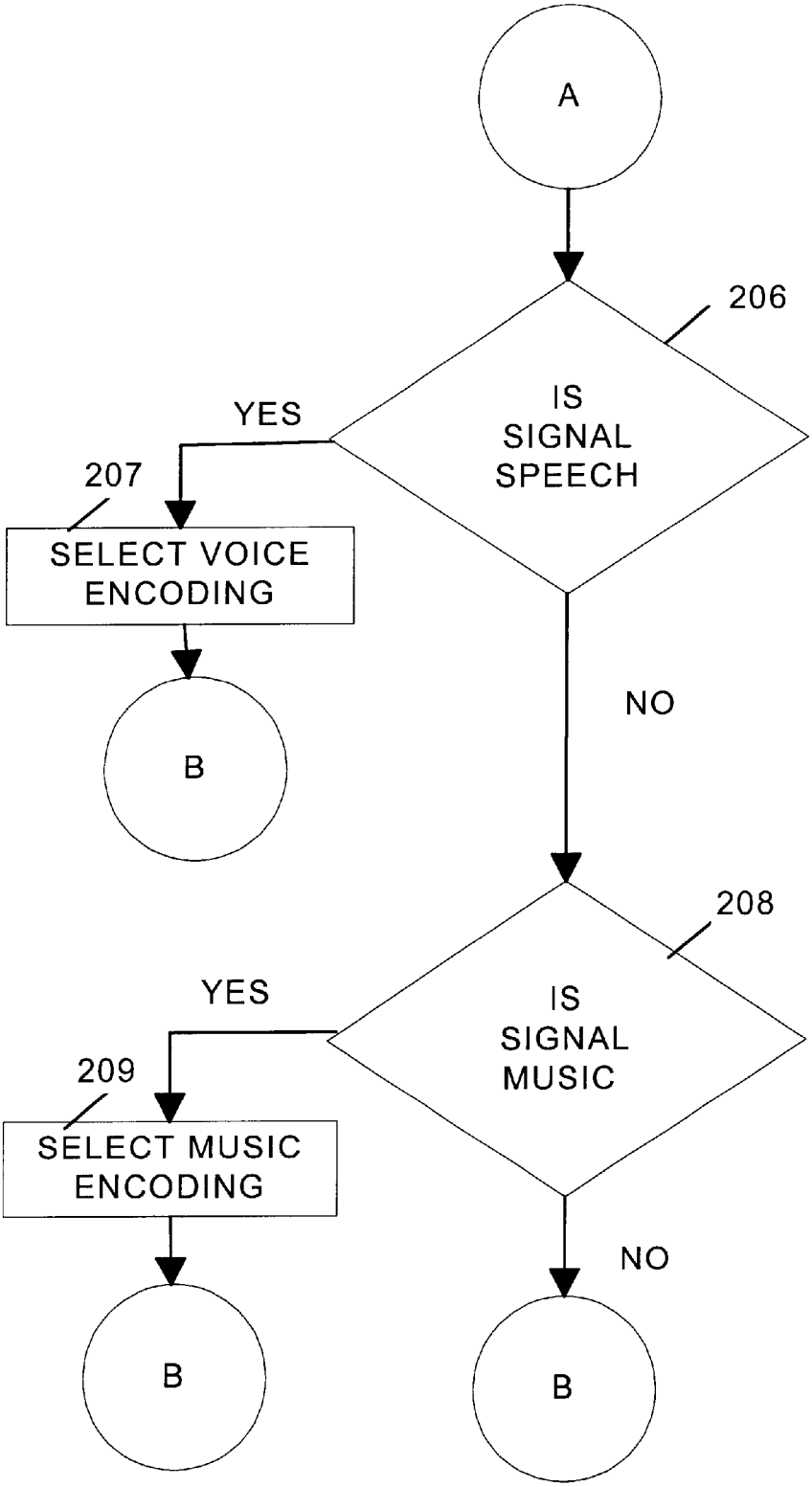

As shown in FIGS. 6A and 6B, initial detection of music or voice is accomplished by the VAD but many other systems could be used to perform this function. Whatever system is used the parameters derived must be sufficient to permit the signal evaluator (classification) module to output data useful in selecting encoders. Signal detection schemes are defined in the most recent G.729G recommended standard, in the Telecommunication Standardization Sector COM 16<no.>-E entitled ITU-T G.729 Annex G proposed for decision: DTX functionality for G.729 Annex E which is attached hereto and incorporated herein by reference and the detection algorithm of the detector includes a section to compute relevant parameters and a section to generate a classification based on such parameters. Music detection for example is in accordance with G.729G is based on the determination of the following parameters as set forth in Table II.

TABLE II

| Signal Feature Parameters |
|---|
| Vad_dec, VAD decision of the current frame. |
| Vad_deci, VAD decision of the previous frame. |
| Lpc_mod, flag indicator of either forward or backward adaptive LPC of the previous frame. |
| Rc, reflection coefficients from LPC analysis. |
| Lag_buf, buffer of corrected open loop pitch lags of last 5 frames. |
| Pgain_buf, buffer of closed loop pitch gain of last 5 subframes. |
| Energy, first autocorrelation coefficient R(0) from LPC analysis. |
| LLenergy, normalized log energy from VAD module. |
| Frm_count, counter of the number of processed signal frames. |
| Rate, selection of speech coder |

Use of the parameters as set forth in COM 16<no.>-E permits the detection of music after speech detection and permits computation of relevant parameters and classification based on these parameters. Thus, G.729G is useful in detecting non-periodic audio such as music which is useful in selecting different encoding formats. G.729G includes detection for VAD and G.729E parameters.

What is claimed is:

1. A dynamic digitized signal detection and selection system comprising:

a signal recognition module for evaluating signal and generating characteristic parameters representative of said signal;

a classification module for classifying said signal based on said characteristic parameters and generating a classification; and a recommendation module for recommending a format for encoding said signal based on said classification;

wherein said format is one of a plurality of encoding methods of different transfer rates.

2. The dynamic digitized signal detection and selection system of claim 1 further comprising:

a voice activity detection module which generates parametric information representative of a voice activity in said signal for evaluation by said signal recognition module; and an encoding module which encodes said signal in accordance with said format.

3. A dynamic signal detection and selection system comprising:

a voice detection module for evaluating digitized signal and generating feature vectors representative of said digitized signal;

a recognition module for evaluating said feature vectors and providing a determination as to whether said digitized signal is voice or non-voice;

a classification module which classifies said digitized signal as a voice or non-voice classification based on said determination; and a recommendation module for recommending a format for encoding said digitized signal based on said voice or non-voice classification;

wherein said format is one of a plurality of encoding methods of different transfer rates.

4. The dynamic signal detection and selection system of claim 3, wherein said classification module classifies said digitized signal based on said classifications selected from a group consisting of:

a. voice;

b. music;

c. noise;

d. modem;

e. facsimile; and f. any combination of a through e.

5. The dynamic signal detection and selection system of claim 3, wherein said plurality of encoding methods comprise at least;

G.729 Annex G.

6. A method for digitized signal detection and dynamically selecting an encoding method for said digitized signal, said method comprising the steps of:

examining said digitized signal;

classifying said digitized signal to generate a classification;

recommending a change in said encoding method previously used to encode said digitized signal, if said classification is different from a previous classification;

increasing an encoding data rate for a first class of said digitized signal; and decreasing the encoding data rate for a second class of said digitized signals;

encoding said digitized signal to generate an encoded signal for transmission to a destination.

7. The method of claim 6 comprising the additional steps of:

packetizing said encoded signal into packets having at least one header and a body;

placing encoding and destination information into said header of said packets; and transmitting said packets to said destination.

8. A method for dynamically selecting an encoding method for a digitized signal, said method comprising the steps of:

examining said digitized signal;

classifying said digitized signal as either voice, noise-and-voice, music-and-voice, music, noise or unknown classification;

recommending a change in said encoding method previously used to encode said digitized signal, if said classification is different from a previous classification;

setting an encoding data rate for said noise-and-voice classification to greater than 11.2 kilobits per second;

setting said encoding data rate for said noise-and-music classification to greater than 11.2 kilobits per second;

setting said encoding data rate for said music classification to greater than 8 kilobits per second;

setting said encoding data rate for said voice or noise classification to less than 8 kilo bits per second;

encoding said digitized signal at said encoding data rate to generate encoded data; and transmitting said encoded data to a destination.

9. A dynamic signal detection and selection system comprising:

a signal recognition module for evaluating a digitized signal and generating characteristic parameters representative of said digitized signal;

a classification module for generating a classification for said digitized signal based on said characteristic parameters;

a recommendation module for generating a recommendation for an encoding format for encoding said digitized signal based on said classification;

a voice activity detection module which generates parametric information representative of a voice activity in said digitized signal for evaluation by said signal recognition module; and an encoding module which applies said encoding format to said digitized signal based on said recommendation;

wherein said encoding format is one of a plurality of encoding methods of different transfer rates selectable by said recommendation module.

10. A dynamic signal detection and selection system comprising:

a voice detection module for evaluating a digitized signal and generating feature vectors representative of said digitized signal;

a recognition module for evaluating the feature vectors and determining if said digitized signal is voice;

a classification module for generating a classification which classifies said digitized signal as voice or non-voice;

a recommendation module for generating a recommendation for an encoding format for encoding of said digitized signal based on said classification; and a selection module for selecting said encoding format based on said recommendation;

wherein said encoding format is one of a plurality of encoding methods of different transfer rates.

11. The dynamic signal detection and selection system of claim 10, wherein said classification module classifies said digitized signal based on said classification selected from a group consisting of:

a. voice;

b. music;

c. noise;

d. modem;

e. facsimile; and f. any combination of a through e.

a. a plurality of encoding standards having different data transfer rates.

12. The dynamic signal detection and selection system of claim 10, wherein said plurality of encoding methods comprise at least G.729 Annex G;

a. a recognition module for evaluating said digitized signal and generating parameters representative of said signal;

b. a classification module for evaluating said parameters and classifying said signal as voice or non-voice; and c. a recommendation module selecting an encoding standard from a plurality of encoding standard having different bit rates for encoding said signal based on said classification.

13. A method for detection and dynamically selecting an encoding format for a digitized signal, said method comprising the steps of:

examining said digitized signal;

classifying said digitized signal and generating a classification indicative of voice or non-voice;

recommending a change in an encoding method previously used to encode said digitized signal, if said classification is different from a previous classification;

increasing an encoding rate for a first class of said digitized signals;

decreasing said encoding rate for a second class of said digitized signal; and encoding said digitized signal to generate an encoded signal for transmission to a destination.

14. The method of claim 13 comprising the additional steps of:

packetizing said encoded signal into packets having at least one header and a body;

placing encoding and destination information into said header of said packets; and transmitting said packets to said destination.

15. A method for a digitized audio signal detection and dynamically selecting an encoding format for said digitized audio signal, said method comprising the steps of:

examining said digitized signal;

classifying said digitized signal to generate a classification;

recommending a change in an encoding method previously used to encode said digitized signal, if said classification is different from a previous classification;

increasing an encoding rate for a first class of said digitized signal;

decreasing said encoding rate for a second class of said digitized signal;

encoding said digitized signal to generate an encoded signal for transmission to a destination; and transmitting said encoded signal to said destination.

16. A method for selecting an encoding format for a digitized audio signal, said method comprising the steps of:

examining said digitized signal;

classifying said digitized signal to generate a classification as either voice, noise-and-voice, music-and-voice, music, or noise;

recommending a change in said encoding method previously used to encode said digitized signal-, if said classification is different from a previous classification;

setting an encoding data rate for a noise-and-voice signal to greater than 11.2 kilobits per second;

setting said encoding rate for a noise-and-music signal to greater than 11.2 kilobits per second;

setting said encoding rate for a music signal to greater than 8 kilobits per second;

setting said encoding rate for a voice or noise signal to less than 8 kilobits per second;

encoding said digitized signal at said encoding rate to generate an encoded signal; and transmitting said encoded signal to a destination.

* * * * *